United States Patent [19]

Gillis

[11] Patent Number: 4,655,640

[45] **Date of Patent: * Apr. 7, 1987**

[54] ADVANCING MECHANISM AND SYSTEM UTILIZING SAME FOR RAISING AND LOWERING A WORK PLATFORM

[75] Inventor: Don A. Gillis, Wenatchee, Wash.

[73] Assignee: Petroleum Structures, Inc., Singapore

[ * ] Notice: The portion of the term of this patent subsequent to Feb. 5, 2002 has been disclaimed.

[21] Appl. No.: 694,333

[22] Filed: Jan. 24, 1985

Related U.S. Application Data

[63] Continuation-in-part of Ser. No. 529,358, Sep. 6, 1983, Pat. No. 4,497,591.

[51] Int. Cl.[4] ..... E02B 17/08; B66F 1/00

[52] U.S. Cl. ..... 405/198; 254/95; 254/105

[58] Field of Search ..... 405/196, 198, 199; 254/95, 105-112

[56] References Cited

U.S. PATENT DOCUMENTS

| | | | |
|---|---|---|---|
| 2,841,961 | 7/1958 | Lucas | 405/199 |
| 2,892,314 | 6/1959 | Hornsby et al. | 405/196 |
| 2,920,870 | 1/1960 | Suderow | 254/93 |
| 2,967,400 | 1/1961 | Grant et al. | 405/199 |
| 2,997,852 | 8/1961 | Suderow | 405/201 |
| 3,028,143 | 4/1962 | Cheskin | 254/105 |
| 3,082,607 | 3/1963 | Sutton | 405/196 |
| 3,195,313 | 7/1965 | Swatek, Jr. | 405/196 |
| 3,605,669 | 9/1971 | Yu | 114/5 |
| 3,722,863 | 3/1973 | Itoh et al. | 254/105 |
| 3,797,256 | 3/1974 | Giblon | 405/196 |
| 3,804,369 | 4/1974 | Sutton | 254/105 |
| 3,967,458 | 7/1976 | Scales | 405/196 |
| 3,986,368 | 10/1976 | Levingston | 405/196 |
| 4,070,868 | 1/1978 | Sedlmayer et al. | 405/199 |
| 4,227,831 | 10/1980 | Evans | 405/196 |
| 4,255,069 | 3/1981 | Yielding | 405/196 |
| 4,265,568 | 5/1981 | Herrmann et al. | 405/196 |
| 4,270,877 | 6/1981 | Post | 405/198 |
| 4,325,654 | 4/1982 | Meckler | 405/196 |
| 4,362,120 | 12/1982 | Dekkers | 114/265 |
| 4,497,591 | 2/1985 | Gillis | 405/198 |

*Primary Examiner*—David H. Corbin

*Attorney, Agent, or Firm*—Delbert J. Barnard

[57] ABSTRACT

A rack (16) extends along a support column (12) for a work platform (10) which is guided for up and down movement along the support column (12). A pair of independently movable supports (32, 34) are provided. A separate extendible/retractable hydraulic cylinder (64, 68) is interconnected between each support (32, 34) and a frame portion (30, 88, 90) of the work platform (10). Each support (32, 34) includes an extendible/retractable lock element (100) having an end portion which when the lock element (100) is extended is in locking engagement with either tooth portions of a pinion wheel (56) carried by the support (32, 34), or with the rack (16). In use, the lock element (100) is extended to lock the support in position relative to the support column (12). At the same time, the hydraulic cylinder (64, 68) which is connected to the support (32 or 34) is extended or retracted to raise or lower the work platform (10). At the same time, the lock element (100) that is associated with the second support is retracted into an unlock position. The second cylinder (64, 68) is moved to a starting point so that at the end of the stroke of the first cylinder (64, 68) the second lock element (100) can be advanced to lock its support in position on the rack and the second lock element (100) can be retracted to free its support for movement along the rack, and the second cylinder (64, 68) can be operated to advance the work platform (10) and the first cylinder (64, 68) can be returned to its start position.

14 Claims, 14 Drawing Figures

ADVANCING MECHANISM AND SYSTEM UTILIZING SAME FOR RAISING AND LOWERING A WORK PLATFORM

CROSS REFERENCE TO RELATED APPLICATION

This application is a continuation-in-part of my copending application Ser. No. 529,358, filed Sept. 6, 1983 and entitled Advancing Mechanism And System Utilizing Same For Raising And Lowering A Work Platform now U.S. Pat. No. 4,497,591, granted Feb. 5, 1985, and also entitled Advancing Mechanism and System Utilizing Same for Raising and Lowering a Work Platform.

TECHNICAL FIELD

This invention relates to a mechanism for stepping a movable member in position along an elongated guide member. More particularly, it relates to such a mechanism which is adapted to provide an almost continuous step-by-step movement, and to a system in which a plurality of such mechanisms are used for raising and lowering a work platform relative to supporting columns.

BACKGROUND ART

The general concept of a step-by-step advancing mechanism is quite old. However, a common problem with known systems is that the step-by-step movement is intermittent and slow. The jacking devices used for causing the movement are operated to cause an increment of movement. Then, such mechanisms must be repositioned while movement is stopped so that they can be used for affecting the next step or increment of movement.

The advancing mechanism of the present invention includes a pair of alternating mechanisms for making step advances. While one of the mechanisms is making a step advance, the other is repositioning itself so that substantially immediately following the step advance it can start making the next step advance. The advancing mechanism of the present invention is especially suitable for use in raising and lowering a platform relative to its support columns.

Mechanisms which exist in the patent literature for raising and lowering platforms relative to support columns are shown by the following U.S. Pat. Nos.: 2,841,961, granted July 8, 1958, to Joseph E. Lucas; 2,892,314, granted June 30, 1959, to John W. Hornsby et al; 2,920,870, granted Jan. 12, 1960, to George E. Suderow; 2,967,400, granted Jan. 10, 1961, to James I. Grant et al; 2,997,852, granted Aug. 29, 1961, to George E. Suderow; 3,028,143, granted Apr. 3, 1962, to David B. Cheskin; 3,082,607, granted Mar. 26, 1963, to John R. Sutton; 3,195,313, granted July 20, 1965, to Edwin P. Swatek; 3,605,669, granted Sept. 20, 1971, to Tsi Van Yu; 3,722,863, granted Mar. 27, 1973, to Isamu Itoh et al; 3,797,256, granted Mar. 19, 1974, to Robert P. Giblon; 3,804,369, granted Apr. 16, 1974, to John R. Sutton; 3,967,458, granted July 6, 1976, to Ralph E. Scales; 3,986,368, granted Oct. 19, 1976, to Clarence W. Levingston; 4,070,868, granted Jan. 31, 1978, to Franz Sedlmayer et al; 4,227,831, granted Oct. 14, 1980, to Darrell L. Evans; 4,255,069, granted Mar. 10, 1981, to Ralph D. Yielding; 4,265,568, granted May 5, 1981, to Robert P. Herrmann et al; 4,270,877, granted June 2, 1981, to Adrianus J. Post; 4,325,654, granted Apr. 20, 1982, to Milton Meckler; and 4,362,120, granted Dec. 7, 1982, to Cornelis Dekkers.

DISCLOSURE OF THE INVENTION

The advancing mechanism of the present invention is relatively simple in its structural makeup and is easy to operate and its use results in an almost continuous movement of the structure which is being moved by it.

In basic form, it comprises a pair of mechanisms, spaced apart along an elongated member. Each mechanism comprises at least one hydraulic cylinder having a first end which is connected to a support and a second end which is attached to a member which is to be moved relatively along the elongated member. Each support carries means by which the support is either locked or unlocked in position relative to the elongated member. In one embodiment the elongated member includes a rack and each support carries a pinion having teeth which are always in engagement with the teeth of the rack. A lock mechanism is associated with each pinion. Each lock mechanism is extendible into locking engagement with tooth portions of its pinion. Each lock mechanism is retractable into an unlock position, freeing the pinion for rotation.

In another embodiment, the pinion is omitted and the support carries a lock mechanism which is extendible into locking engagement with the rack. Such lock mechanism is retractable into an unlock position, freeing the support for movement relatively along the rack.

One of the cylinders is retracted or retracting and the other is extended or extending. In operation, one of the supports is locked in position relative to the rack, and the cylinder attached thereto is operated for the purpose of moving a second member to which the opposite end of such cylinder is attached in position relatively along to the elongated member. At the same time, the other cylinder is used for repositioning its support, so that substantially immediately following the step of movement caused by the first cylinder, the second cylinder is ready to be used for causing the next step.

In accordance with the invention, the elongated member may be fixed and the advancing mechanism of this invention used for moving the second member relative to it. Or, the second member may be fixed and the advancing mechanism of this invention may be used for moving the elongated member relative to the second member.

There are important constructional details and specific component arrangement which are also aspects of the present invention. Also, a system utilizing the above principles is an aspect of the invention. Such constructional details, component arrangements, and the system are described in the description of the best mode for carrying out the invention, and are particularly pointed out and distinctly claimed in the appended claims. Accordingly, the description of the best mode for carrying out the invention and the appended claims constitute portions of the disclosure of the invention.

BRIEF DESCRIPTION OF THE DRAWINGS

In the drawings, like reference numerals are used throughout the several figures, and.

BEST MODE FOR CARRYING OUT THE INVENTION

Figure 1:
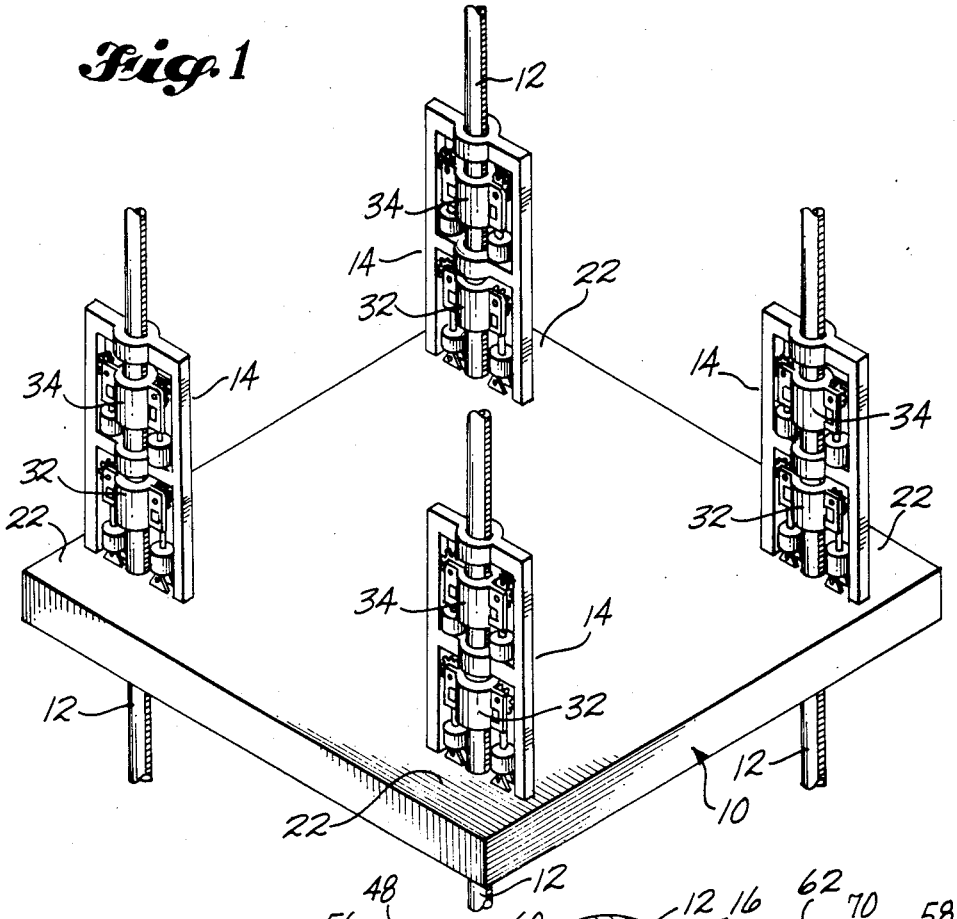
FIG. 1 is a pictorial view, taken from above and looking towards one corner of a column supported platform, showing in advanced mechanism interconnected between each column and a related corner portions of the platform.

Referring to FIG. 1, an offshore work platform 10 is supported at its corners by a set of support columns 12. The platform 10 is vertically movable in position relative to the columns 12. Movement is achieved by operation of a set of four advance mechanisms, each one of which is interconnected between one of the corner portions of the platform 10 and the column 12 at such corner.

The advancing mechanism of the present invention is especially suited for use in raising and lowering a work platform in position relative to its support columns, and the system formed by combining the advancing mechanism with a work platform and its support columns is a very important aspect of the invention. However, the advancing mechanism has general utility and can be used for shifting many types of movable members in position relatively along many different types of elongated members.

The advancing mechanism concepts of the invention will now be described, in conjunction with the illustrated work platform raising and lowering system.

In the illustrated embodiment, the elongated guide member is a support column 12, which may be tubular in form. Preferably, each column 12 carries a pair of racks 16, occupying diametrically opposed positions on the column 12.

A support frame 18 is secured at its lower end 20 to a corner portion 22 of the platform 10. The frame 18 comprises a pair of upright side members 24, 26, an upper cross member 28 and an intermediate cross member 30. Frame 18 is an integral part of the platform or movable member 10.

The mechanism includes a pair of pinion wheel supports or yokes 32, 34, spaced apart along the column or guide member 12. In preferred form, each yoke 32, 34 includes a central portion 36 (FIGS. 4–6) which surrounds the column 12 and a pair of side, pinion wheel mounting portions 38, 40. In like fashion, each cross member 28, 30 includes a central portion 42 which surrounds the column 12 and a pair of hydraulic cylinder anchoring side portions. In the case of cross member 30, the side portions 44, 46 serve as anchor points for a pair of hydraulic cylinders.

Figure 4:
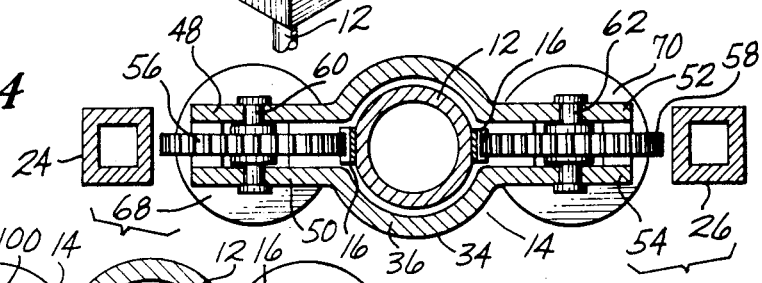
FIG. 4 is a cross sectional view taken substantially along line 4—4 of FIG. 2.
Figure 5:
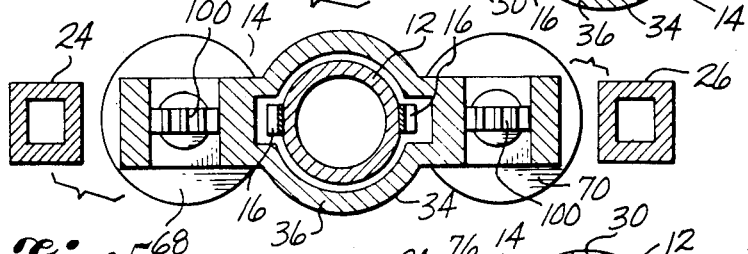
FIG. 5 is a cross sectional view taken substantially along line 4—4 of FIG. 2.

As best shown by FIG. 4, yoke end portions 38, 40 of yokes 32, 34 each includes a pair of spaced apart side cheeks 48, 50 or 52, 54. A pinion wheel 56 is positioned between the side cheeks 48, 50 and a pinion wheel 56 is positioned between the side cheeks 52, 54. The pinions 56, 58 are mounted for rotation by means of shafts 60, 62 which extend between and at their ends are carried by the cheeks 48, 50 and 52, 54, respectively.

The pinions 56, 58 have peripheral teeth which are always in engagement with the teeth of the racks 16.

In the illustrated embodiment, a separate pair of hydraulic cylinders is interconnected between each pinion wheel support 32, 34 and the movable structure. The cylinders associated with yoke 32 are designated 64, 66. The cylinders associated with yoke 34 are designated 68, 70. One end of each cylinder 64, 66, 68, 70 is secured to the movable structure and the opposite end is connected to a yoke structure 32, 34. In the illustrated embodiment, the barrel or chamber housing portions of the cylinders 64, 66, 68, 70 are pin connected at their low ends to the movable structure. The opposite end of the cylinder 64, 66, 68, 70, which is the free end of the piston rod, makes a fixed connection to the yoke 32 or 34.

Figure 6:
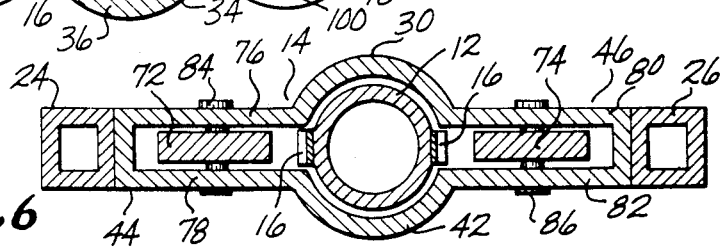
FIG. 6 is a cross sectional view taken substantially along line 6—6 of FIG. 2.

As best shown by FIG. 6, the lower end of each cylinder 68, 70 may include a mounting ear 72, 74 which is positioned between side plate portions 76, 78, and 80, 82 of the frame cross member 30. A pivot joint establishing pin 84 expands between members 76 and 80, and through an opening in the member 72. In similar fashion, a pivot joint establishing pin 86 extends between side members 80, 82, and through an opening in member 74. A similar arrangement exists at the lower ends of cylinders 64, 66, except that the side members are in the nature of side plates which project upwardly from the upper surface of platform 10. The foreground mounting plates are designated 88, 90 in FIGS. 2 and 3 and the pivot joint establishing pins are designated 92, 94.

Figures 2, 3, 7:
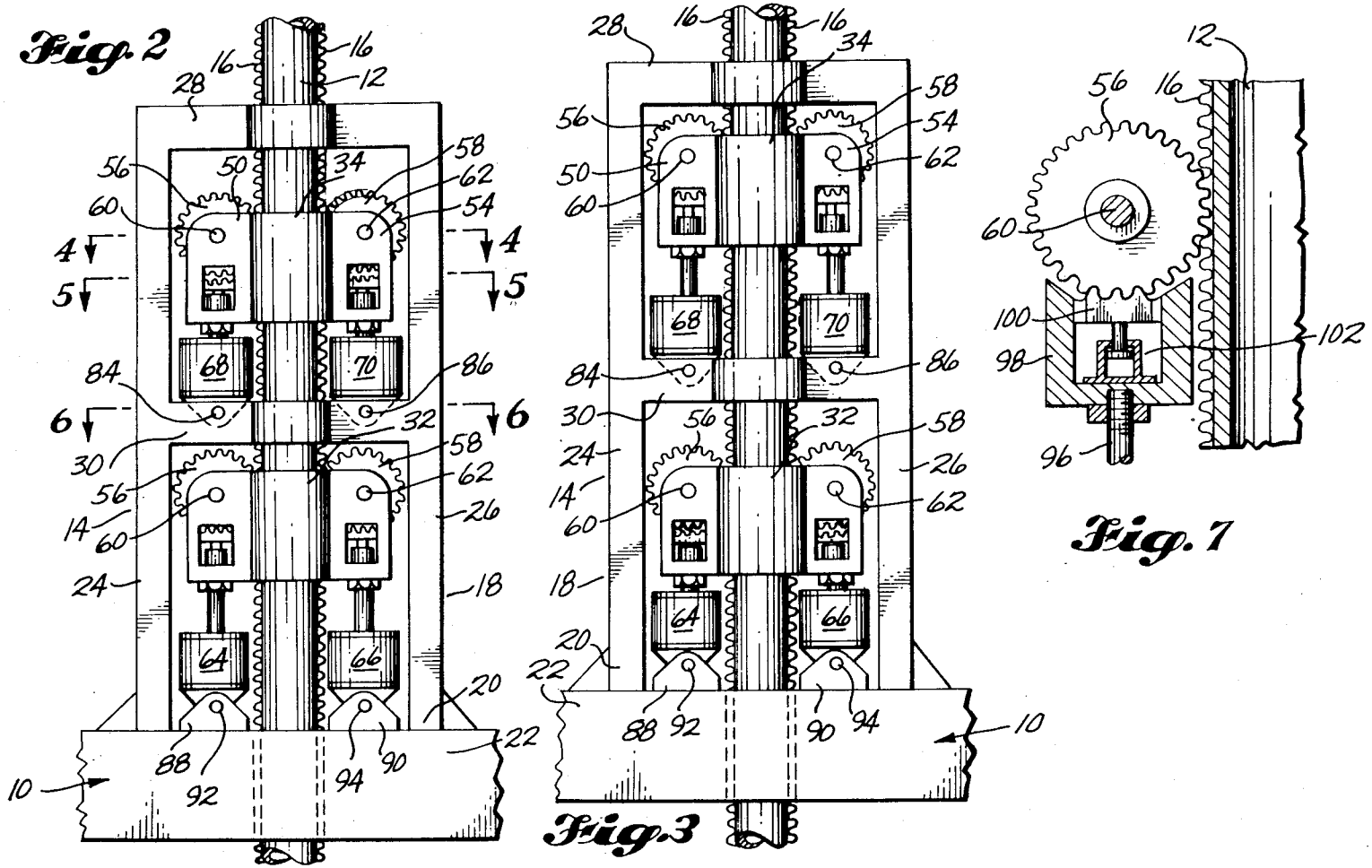
FIG. 2 is an elevational view of one of the advancing mechanisms, showing a lower set of cylinders advancing, an upper set of cylinders retracted, an upper pair of pinion wheels free to rotate along racks carried by the guide column, and a lower pair of pinions locked against rotation, and in a fixed position relative to the guide column, so that the upper pair of hydraulic cylinders can be advanced for moving the upper pair of pinions in position relative to the guide column and the lower pair of hydraulic cylinders can be retracted for the purpose of lifting the platform.
FIG. 3 is a view like FIG. 2, but at the end of the just described step of operation, and showing the upper pair of pinion wheels locked against rotation and the lower pair of pinion wheels unlocked, so that the lower pair of cylinders can now be used for moving the lower pair of pinions in position along the guide column while at the same time the upper pair of cylinders are being retracted for the purpose of lifting the platform an additional increment.
FIG. 7 is an enlarged scale fragmentary view, with some parts in side elevational and some parts in longitudinal section, showing an embodiment of the extendible-retractable lock element which is associated with each pinion wheel.
Figure 10:
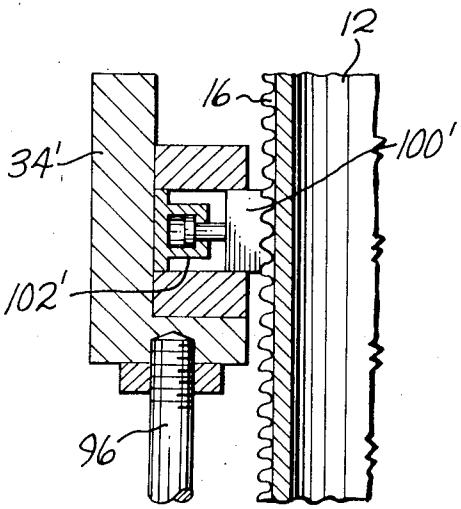
FIG. 10 is a view like FIG. 7, but of the lock mechanism for the embodiment shown by FIGS. 8 and 9.
Figure 9:
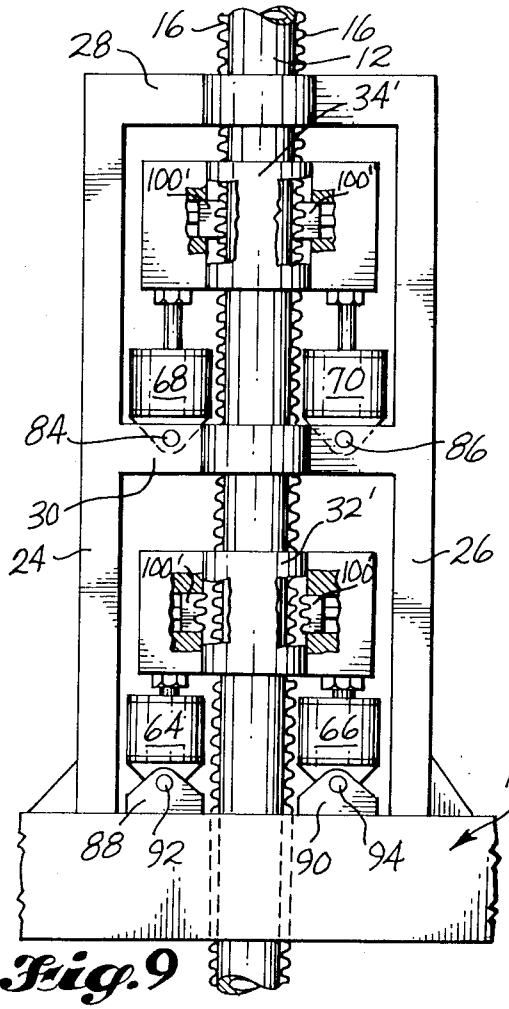
FIG. 9 is a view like FIG. 3, but of the embodiment shown by FIG. 8.
Figure 8:
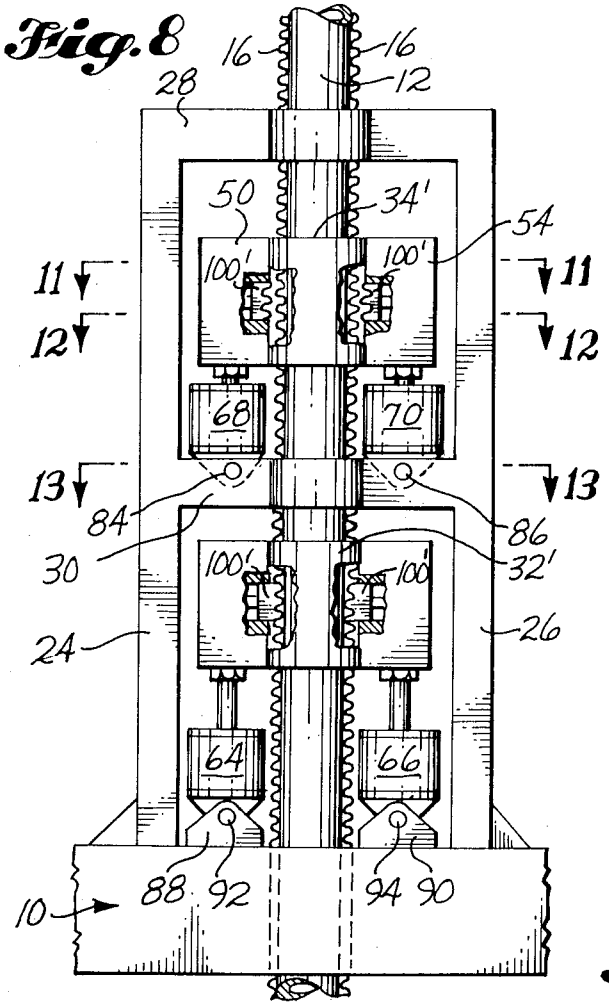
FIG. 8 is a view like FIG. 2, but of a modified form of the invention, in which the pinion wheels have been omitted and the like mechanisms have been oriented to be movable into and out of locking engagement with the rack.

As shown by FIG. 7, the upper end of each piston rod 96 may be thread connected to a mounting box portion 98 of its end of a yoke 32, 34. In accordance with an aspect of the invention, a lock mechanism is provided for each pinion 56, 58. The lock mechanism has a locked position in which it makes locking engagement with tooth portions of the pinion 56, 58, to in that manner prevent the pinion 56, 58 from rotating, and an unlocked position in which it is moved out from engagement with tooth portions of the pinions, 56, 58. In the illustrated embodiment, the lock mechanism is in the form of an extendible-retractable element that is housed within housing 98. This element is designated 100 and it carries a plurality of teeth which are designed to engage teeth on the periphery of a pinion 56, 58. The lock element 100 may be positioned by means of a small fluid cylinder 102 (FIG. 7).

In operation, one pair 64, 66 or 68, 70 of the hydraulic cylinders 64, 66, 68, 70 is retracted and the other is extended. In FIG. 2 the cylinders 68, 70 are retracted and the cylinders 64, 66, are extended. If it is desired to move the movable platform or member 10 upwardly, the lock elements 100 associated with the lower pair of pinions 56, 58 are extended for the purpose of locking the pinions 56, 58 in position relative to the column 12. The upper set of pinions 56, 58 are left unlocked. Then, the cylinders 64, 66 are retracted while at the same time the cylinders 68, 70 are extended. As cylinders 64, 66 retract, they pull the platform 10 upwardly relative to the anchored yokes 32. At the same time, the cylinders 68, 70 reposition the yoke 34 upwardly so that by the time the cylinders 64, 66 are fully retracted the cylinders 68, 70 are fully extended, and the step can be repeated, but with the cylinders 68, 70 being used this time to lift the platform 10 an additional increment. Immediately following forward traction of cylinders 64, 66 and full extension of cylinders 68, 70, the upper set of lock elements 100 are moved into positions of locking engagement with the pinions 56, 58. Then, the lower set of lock elements 100 are retracted to unlock the lower pinions 56, 58. Then, the cylinders 68, 70 are retracted, for lifting the platform, and the same time the cylinders 64, 66 are extended, for the purpose of repositioning the yoke 32.

As will be easily appreciated, the process is reversible. That is, the platform can be moved downwardly by locking in position the pinions 56, 58 which are carried by the yoke that is connected to the retracted cylinders. Then, extension of the retracted cylinders will move the platform downwardly relative to the anchored yoke against which the cylinders are pushing as they extend. At the same time, the other set of cylinders are being retracted, for the purpose of repositioning the yoke to which they are connected.

As will be appreciated, the advancing mechanism of the present invention provide an almost continuous raising or lowering of the platform 10. Essentially immediately at the end of each increment of advancement the second assembly of cylinders is ready to commence another step of advancement. There is no waiting for a single advancement mechanism to be repositioned so it can be used for effecting the next step.

FIGS. 8–13 show a modified embodiment. The only difference between this embodiment and the embodiment shown by FIGS. 1–7 is that the pinion wheels are omitted and the lock elements 100′ are oriented to be moved by the hydraulic cylinders 102′ into and out from locking engagement with the rack 16. Thus, in operation, the lock element or elements 100′ carried by one of the supports 32′, 34′ is (are) extended into locking engagement with the rack(s) 16, and the locking element 100′ carried by the other support 32′, 34′ is (are) withdrawn from locking engagement with the rack(s) 16. As in the first embodiment, the support 32′, 34′ which is locked in position relative to the rack(s) 16 provides something against which the hydraulic cylinders can react, for moving the frame 14, and the platform 10 to which it is connected, relatively along the rack. At the same time, the cylinder(s) connected to the unlock support 32′, 34′ can be returned to a start position. The sequence of operation is identical to what is described above in connection with the embodiment shown by FIGS. 1–7.

Figure 14:
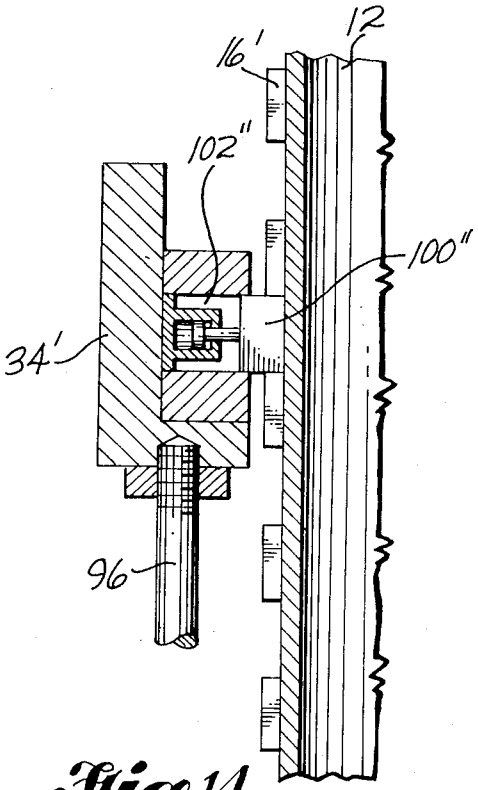
FIG. 14 is a view like FIGS. 7 and 10, but of a third embodiment, in which the rack includes large size teeth and the lock element is moved into and out from a space between an adjacent pair of teeth.
Figure 11:
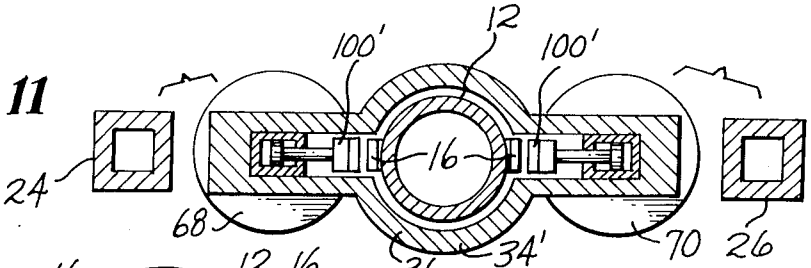
FIG. 11 is a view like FIG. 4, but of the embodiment of FIGS. 8–10.
Figure 12:
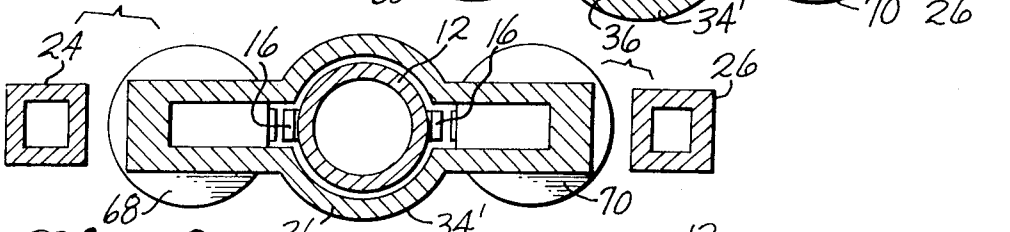
FIG. 12 is a view like FIG. 5, but of the embodiment shown by FIGS. 8–11.
Figure 13:
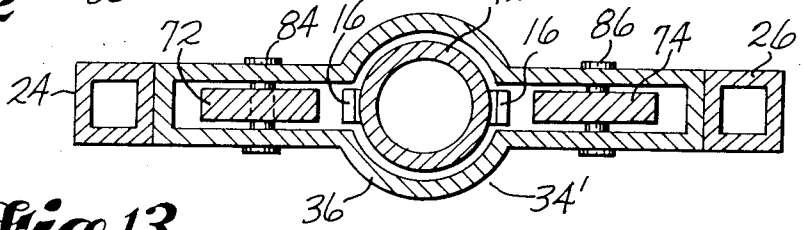
FIG. 13 is a view like FIG. 6, but of the embodiment of FIGS. 8–12.

FIG. 14 shows another modified embodiment. In this embodiment the rack 16′ has large teeth and large spaces between the teeth. The lock element 100″ is moved into and out from between the tooth spaces, for locking the frame 32′, 34′ to, or unlocking it from, the column 12. An installation equipped with a large tooth rack 16′ is in other respects like the embodiment shown by FIGS. 8–13, and the sequence of operation is the same.

What is claimed is:

1. An advancing mechanism, comprising:

an elongated guide member, including at least one rack extending along a side thereof, said rack comprising spaced apart tooth elements, with spaces between the tooth elements;

a movable member guided for movement along said guide member;

a pair of spaced apart supports, each carrying means operable for locking the support in position relative to the rack and the elongated guide member, or unlocking the support so that such support can be moved in position relative to the rack and the elongated guide member; and a separate extendible/retractable hydraulic cylinder interconnected between each said support and the movable member, whereby a first one of the supports can be locked to the rack, to in that manner hold it in position relative to the rack and the guide member, while at the same time the hydraulic cylinder connected to said first support is extended or retracted to move the movable member in position relative to the first support, and to the same time the second support is unlocked from the rack and the second cylinder is moved to a starting position, so that at the end of the stroke of the first cylinder, the second support can be locked to the rack and the guide member, and the first support unlocked from the rack and the guide member, and then the second cylinder can be operated to advance the movable member and the first cylinder can be returned to a start position.

2. An advancing mechanism according to claim 1, wherein each support carries an extendible/retractable lock element having an end portion which when the lock element is extended is in locking engagement with said rack, and when retracted is out of locking engagement with the rack.

3. An advancing mechanism according to claim 1, wherein each support carries a pinion wheel which engages the rack, and each support further includes selectively operable means for either locking the pinion against rotation or unlocking the pinion so that it may rotate.

4. An advancing mechanism according to claim 2, wherein each extendible/retractable lock element includes a two-way fluid motor for moving the lock element between its extended and retracted position.

5. An advancing mechanism, comprising:

an elongated guide member, including at least one rack extending along a side thereof, said rack comprising spaced apart tooth elements;

a movable member guided for movement along said guide member;

a pair of spaced apart lock element supports, each carrying an extendible-retractable lock element having an end portion which when the lock element is extended is in locking engagement with said rack, and when retracted is out of locking engagement with the rack; and a separate extendible-retractable hydraulic cylinder interconnected between each lock element support and the movable member, whereby the lock element associated with a first one of the lock element supports can be extended into locking engagement with the rack, to in that manner hold said lock element support in position relative to the guide member, while at the same time the hydraulic cylinder connected to the first lock element support is extended or retracted to move the movable member in position relative to the first lock element support and the guide member, and at the same time the lock element carried by the second lock element support is retracted into an unlocked position, and the second cylinder is moved to a starting position, so that at the end of the stroke of the first cylinder the second lock element can be advanced to lock the second lock element support in position relative to the guide member, the first lock element can be retracted to free the first lock element support from the rack carried by the guide member, and then the second cylinder can be operated to advance the movable member and the first cylinder can be returned to a start position.

6. An advancing mechanism according to claim 5, wherein the guide member includes a pair of racks, extending along opposite sides of the guide member, and each lock element support includes a pair of lock elements, each in engagement with a different one of the racks.

7. An advancing mechanism according to claim 6, comprising a pair of extendible-retractable hydraulic cylinders interconnected between each lock element support and the movable member.

8. An advancing mechanism according to claim 5, wherein each extendible-retractable lock element includes a two way fluid motor for moving the lock element between its extended and retracted position.

9. An advancing mechanism according to claim 5, wherein said movable member includes a base portion to which an end of the first hydraulic cylinder is connected and a frame portion projecting from said base portion along said guide member to a mounting portion for an end of the second hydraulic cylinder.

10. A work platform, comprising:

a platform member;

a plurality of support columns for the platform member;

and a mechanism for raising and lowering the platform member, comprising:

at least one rack extending along a side of at least one support column;

a movable member guided for movement along said support column;

a pair of spaced apart supports, each carrying means operable for locking the support in position relative to the rack and the elongated guide member, or unlocking the support so that such support can be moved in position relative to the rack and the elongated guide member; and a separate extendible/retractable hydraulic cylinder interconnected between each said support and the movable member, whereby a first one of the supports can be locked to the rack, to in that manner hold it in position relative to the rack and the guide member, while at the same time the hydraulic cylinder connected to said first support is extended or retracted to move the movable member in position relative to the first support, and at the same time the second support is unlocked from the rack and the second cylinder is moved to a starting position, so that at the end of the stroke of the first cylinder, the second support can be locked to the rack and the guide member, and the first support unlocked from the rack and the guide member, and then the second cylinder can be operated to advance the movable member and the first cylinder can be returned to a start position.

11. A work platform according to claim 10, wherein each support carries an extendible/retractable lock element having an end portion which when the lock element is extended is in locking engagement with said rack, and when retracted is out of locking engagement with the rack.

12. A work platform according to claim 10, wherein each support carries a pinion wheel which engages the rack, and each support further includes selectively operable means for either locking the pinion against rotation or unlocking the pinion so that it may rotate.

13. A work platform according to claim 12, wherein each extendible/retractable lock element includes a two-way fluid motor for moving the lock element between its extended and retracted position.

14. A work platform according to claim 10, wherein said movable member includes a base portion to which an end of the first hydraulic cylinder is connected and a frame portion projecting from said base portion along said guide member to a mounting portion for an end of the second hydraulic cylinder.

* * * * *

UNITED STATES PATENT AND TRADEMARK OFFICE

CERTIFICATE OF CORRECTION

PATENT NO. : 4,655,640

DATED : April 7, 1987

INVENTOR(S) : Don A. Gillis

It is certified that error appears in the above-identified patent and that said Letters Patent are hereby corrected as shown below:

Column 2, line 37, delete "to".

Column 2, line 50, "arrangement" should be -- arrangements --.

Column 2, line 66, "in" should be -- an --.

Column 2, lines 67 and 68, "portions" should be -- portion --.

Column 3, line 34, "like" should be -- lock --.

Column 4, line 49, "low" should be -- lower --.

Claim 1, column 6, line 47, "to" should be -- at --.

Signed and Sealed this

Eighth Day of September, 1987

*Attest:*

*Attesting Officer*

DONALD J. QUIGG

*Commissioner of Patents and Trademarks*